US009234306B1

(12) United States Patent
Chang

(10) Patent No.: US 9,234,306 B1
(45) Date of Patent: Jan. 12, 2016

(54) KNITTING LOOM

(71) Applicant: Donwei Machinery Ind. Co., Ltd., Taichung (TW)

(72) Inventor: Pi-Chao Chang, Taichung (TW)

( * ) Notice: Subject to any disclaimer, the term of this patent is extended or adjusted under 35 U.S.C. 154(b) by 0 days.

(21) Appl. No.: 14/566,221

(22) Filed: Dec. 10, 2014

(51) Int. Cl.
*D04B 5/00* (2006.01)
*D04B 3/00* (2006.01)

(52) U.S. Cl.
CPC ... *D04B 5/00* (2013.01); *D04B 3/00* (2013.01)

(58) Field of Classification Search
CPC ..... D04B 3/00; D04B 5/00; D04B 39/00
USPC ..... 66/3, 4, 1 A
See application file for complete search history.

(56) References Cited

U.S. PATENT DOCUMENTS 1,318,604 A * 10/1919 Schneider ..... D04B 39/00 66/4
2,270,619 A * 1/1942 Bowyer ..... D04B 39/00 66/4
3,577,748 A * 5/1971 Nortland ..... D04B 39/00 66/4
3,678,709 A * 7/1972 Nowicki ..... D04B 39/00 66/4
3,967,467 A * 7/1976 Leach, Sr. ..... D04B 3/00 66/4
4,158,296 A * 6/1979 Dunlop ..... D04B 5/00 66/4
4,248,063 A * 2/1981 Wang ..... D04B 3/00 66/4
4,729,229 A * 3/1988 Whicker ..... D04B 3/00 66/4
5,413,150 A * 5/1995 Townsend ..... D03D 29/00 139/34
8,402,794 B2 * 3/2013 Sasur ..... D04B 3/00 66/3
8,596,096 B1 * 12/2013 Russell ..... D04B 3/00 66/4
2008/0156043 A1 * 7/2008 Gustin ..... D04B 5/00 66/4
2008/0223083 A1 * 9/2008 Gustin ..... D04B 5/00 66/1 A

* cited by examiner

*Primary Examiner* — Danny Worrell

(57) ABSTRACT

A knitting loom is provided with a base having top and bottom, the base including a plurality of knitting pegs equidistantly projecting upward from the top of the base, each of the knitting pegs having a top hole and a vertical groove formed on an outer surface; a plurality of convex risers each formed on a joining portion of the knitting peg and the top of the base, a plurality of cavities formed on the top of the base, each of the cavities communicating with the vertical groove, and a plurality of wells equidistantly formed on the bottom of the base; and a plurality of pins each including a shank fastened in the top hole, and an enlarged head.

1 Claim, 4 Drawing Sheets

KNITTING LOOM

BACKGROUND OF THE INVENTION

1. Field of the Invention

The invention relates to hand held knitting looms and more particularly to such a knitting loom for knitting garments with improved characteristic.

2. Description of Related Art

Weaving may utilize different kinds of looms such as hand held knitting looms which are for example circular and have upwardly projecting knitting pegs.

However, drawbacks of the typical hand held knitting loom are time consuming in producing knits, cumbersome in adjustment, and inconvenient in use.

Thus, the need for improvement still exists.

SUMMARY OF THE INVENTION

It is therefore one object of the invention to provide a knitting loom comprising a base having a top and a bottom, the base including a plurality of knitting pegs equidistantly projecting upward from the top of the base, each of the knitting pegs having a top hole and a vertical groove formed on an outer surface; a plurality of convex risers each formed on a joining portion of the knitting peg and the top of the base, a plurality of cavities formed on the top of the base, each of the cavities communicating with the vertical groove, and a plurality of wells equidistantly formed on the bottom of the base; and a plurality of pins each including a shank fastened in the top hole, and an enlarged head.

The above and other objects, features and advantages of the invention will become apparent from the following detailed description taken with the accompanying drawings.

DETAILED DESCRIPTION OF THE INVENTION

Figure 1:
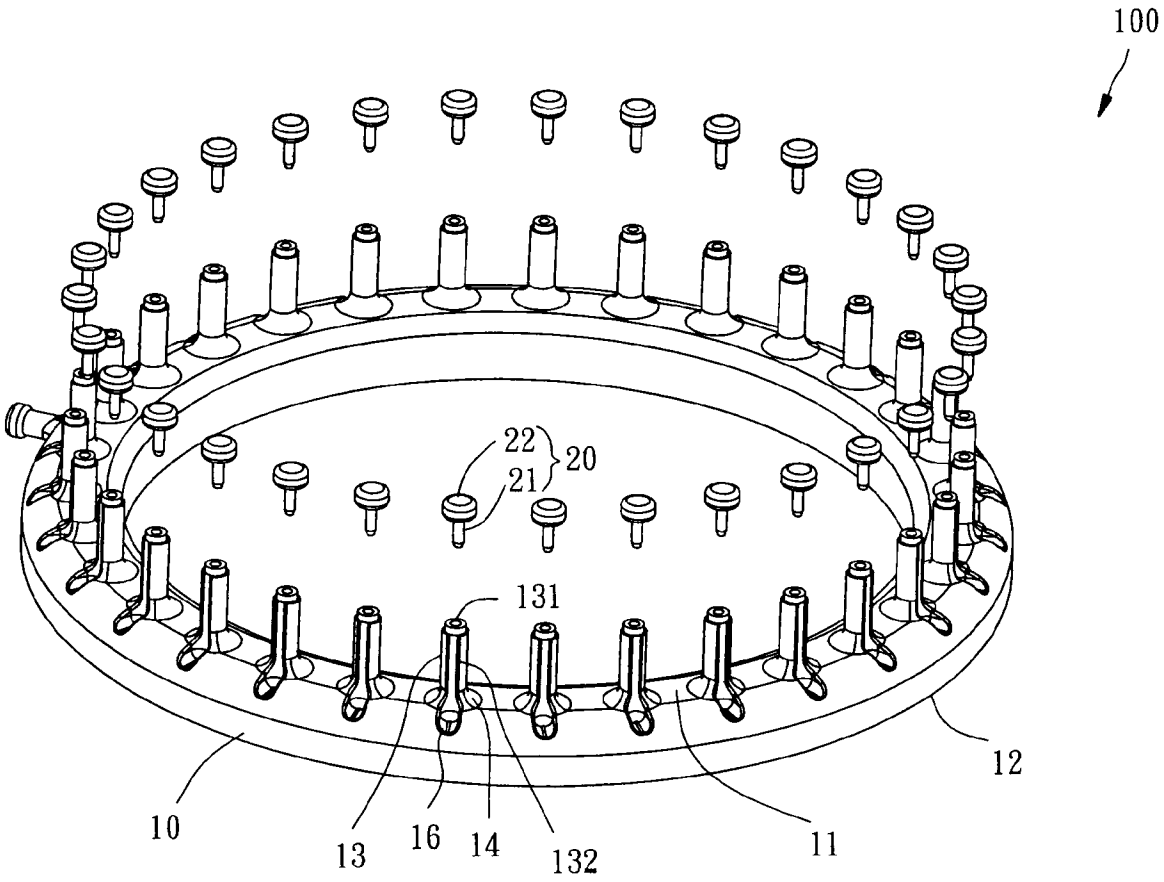
FIG. 1 is an exploded perspective view of a knitting loom according to a first preferred embodiment of the invention.
Figure 2:
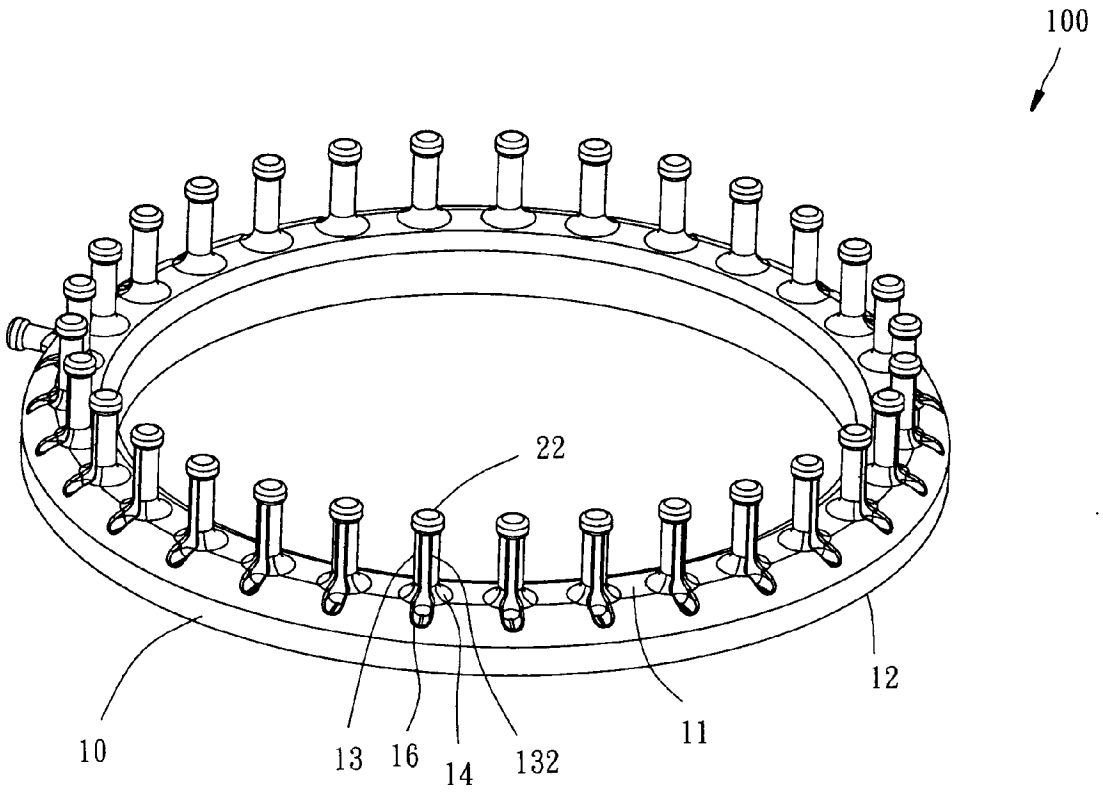
FIG. 2 is a perspective view of the assembled knitting loom.
Figure 3:
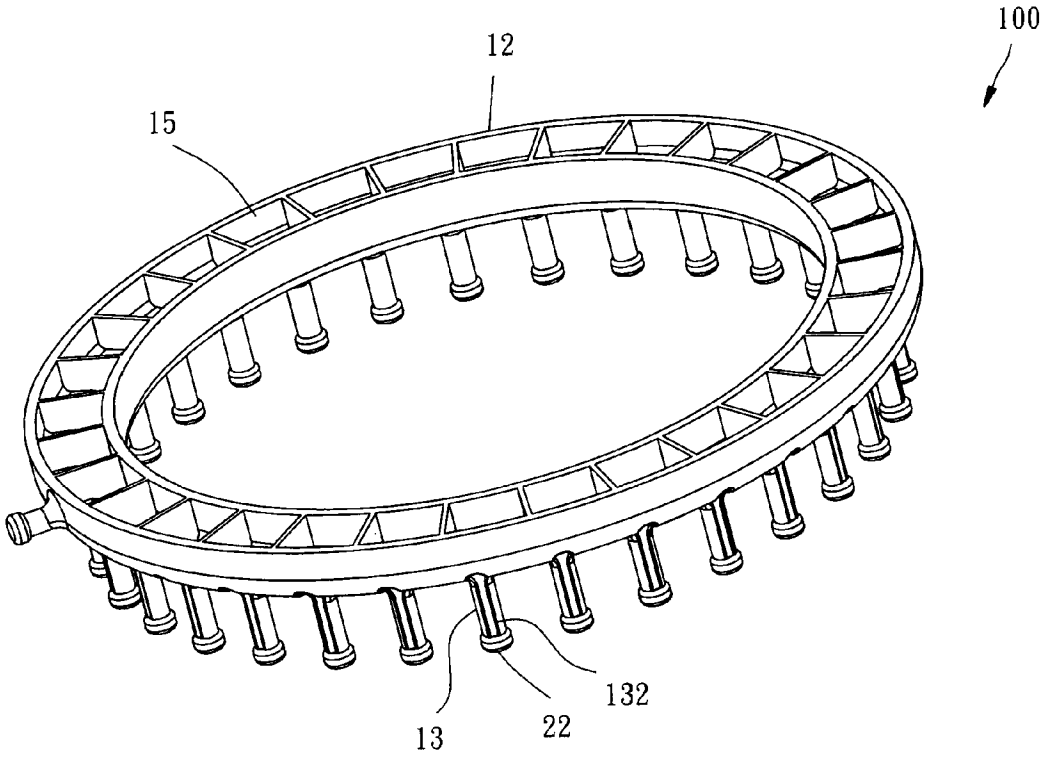
FIG. 3 is another perspective view of the assembled knitting loom.

Referring to FIGS. 1 to 3, a knitting loom 100 in accordance with a first preferred embodiment of the invention comprises the following components as discussed in detail below.

A circular base 10 includes a top 11, a bottom 12, a plurality of knitting pegs 13 equidistantly projecting upward from the top 11, the knitting peg 13 having a hole 131 on a top and a vertical groove 132 formed on an outer surface, a plurality of convex risers 14 each formed on a joining portion of the knitting peg 13 and the top 11, a plurality of cavities 16 formed on the top 11, the cavity 16 communicating with the bottom of the vertical groove 132, and a plurality of wells 15 equidistantly formed on the bottom 12.

A plurality of pins 20 each includes a shank 21 and an enlarged head 22. The shank 21 is fastened in the hole 131.

Figure 4:
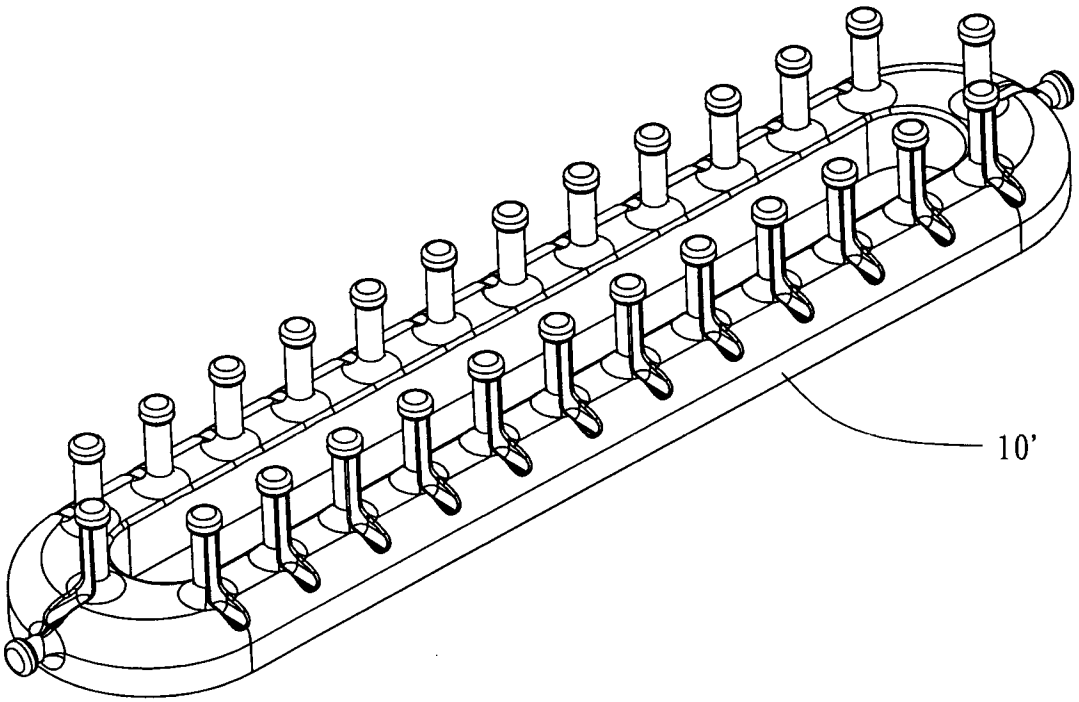
FIG. 4 is an exploded perspective view of a knitting loom according to a second preferred embodiment of the invention.

Referring to FIG. 4, a knitting loom 10' in accordance with a second preferred embodiment of the invention is shown. The characteristics of the second preferred embodiment are substantially the same as that of the first preferred embodiment except the following: The base 10 is oval.

It is envisaged by the invention that the following advantages are obtained. Assembly is simplified. The structural strength is increased due to the provision of the convex risers 14. Weight is decreased due to the provision of the wells 15. Hand knitting is made easy due to the provision of the cavities 16.

While the invention has been described in terms of preferred embodiments, those skilled in the art will recognize that the invention can be practiced with modifications within the spirit and scope of the appended claims.

What is claimed is:

1. A knitting loom comprising:

a base having a top and a bottom, the base including a plurality of knitting pegs equidistantly projecting upward from the top of the base, each of the knitting pegs having a top hole and a vertical groove formed on an outer surface; a plurality of convex risers each formed on a joining portion of the knitting peg and the top of the base, a plurality of cavities formed on the top of the base, each of the cavities communicating with the vertical groove, and a plurality of wells equidistantly formed on the bottom of the base; and a plurality of pins each including a shank fastened in the top hole, and an enlarged head.

* * * * *